US010563476B2

(12) United States Patent
Smith et al.

(10) Patent No.: US 10,563,476 B2
(45) Date of Patent: Feb. 18, 2020

(54) FRAC PLUG WITH INTEGRATED FLAPPER VALVE

(71) Applicants: Roddie R. Smith, Katy, TX (US); Robert Joe Coon, Missouri City, TX (US)

(72) Inventors: Roddie R. Smith, Katy, TX (US); Robert Joe Coon, Missouri City, TX (US)

(73) Assignee: PETROFRAC OIL TOOLS, LLC, Waller, TX (US)

( * ) Notice: Subject to any disclaimer, the term of this patent is extended or adjusted under 35 U.S.C. 154(b) by 191 days.

(21) Appl. No.: 15/674,615

(22) Filed: Aug. 11, 2017

(65) Prior Publication Data

US 2018/0051532 A1 Feb. 22, 2018

Related U.S. Application Data

(60) Provisional application No. 62/377,979, filed on Aug. 22, 2016.

(51) Int. Cl.

| | |
|---|---|
| ***E21B 33/129*** | (2006.01) |
| ***E21B 34/10*** | (2006.01) |
| ***E21B 34/06*** | (2006.01) |
| *E21B 34/00* | (2006.01) |

(52) U.S. Cl.
CPC ..... *E21B 33/1293* (2013.01); *E21B 34/063* (2013.01); *E21B 34/10* (2013.01); *E21B 2034/005* (2013.01)

(58) Field of Classification Search
CPC .. E21B 33/1293; E21B 33/134; E21B 34/063; E21B 34/10; E21B 43/26; E21B 2034/005
See application file for complete search history.

(56) References Cited

U.S. PATENT DOCUMENTS

2013/0240203 A1* 9/2013 Frazier ..... E21B 33/129 166/193

* cited by examiner

*Primary Examiner* — Yong-Suk Ro
(74) *Attorney, Agent, or Firm* — Nolte Intellectual Property Law Group

(57) ABSTRACT

A frac plug is provided. The frac plug may include a plug body, a slip, a sealing element, and a flapper. The plug body may have an inner surface, a first end portion, and a second end portion. The inner surface may define a bore extending axially between the first end portion and the second end portion. The slip may be circumferentially disposed about the plug body and configured to expand and couple the frac plug to a tubular section. The sealing element may be circumferentially disposed about the plug body and configured to compress and create a seal between the plug body and an inner surface of the tubular section. The flapper may be coupled to the plug body proximate to the first end portion and configured to seal the bore of the plug body.

19 Claims, 9 Drawing Sheets

FRAC PLUG WITH INTEGRATED FLAPPER VALVE

CROSS-REFERENCE TO RELATED APPLICATIONS

This application claims the benefit of U.S. Provisional Patent Application Ser. No. 62/377,979, filed on Aug. 22, 2016. The provisional patent application is hereby incorporated by reference in its entirety into the present application to the extent consistent with the present application.

BACKGROUND

In oil and gas production, it is sometimes beneficial to stimulate a reservoir by pumping in high pressure fluids and particulates, such as sand. In order to do this, one or more tubular sections of a tubular installed in the well may need to be isolated for a period of time and re-opened so the well can be produced.

One means of isolation is a frac plug. A frac plug is a hollow, cylindrical plug which can be installed in the tubular to isolate one or more sections. Current designs generally utilize a sealing ball that is pumped into place against the plug. Seating the sealing ball stops fluid flow through the bore of the frac plug. In addition, a seal may be disposed between the outer diameter of the frac plug and the tubular to prevent flow therebetween. Thus, hydrocarbons from the reservoir cannot flow through the bore of the frac plug and cannot divert around the outside of the frac plug. This isolates the selected portions of the well by preventing fluid flow from the surface to the reservoir and vice versa.

Frac plugs are usually built around a central mandrel. Typically, the central mandrel is then positioned in the wellbore and held in place using upper and lower slips. However, such designs may shift within the tubular section when the sealing ball is installed. Additionally, a portion of the wellbore may be horizontal and it can be difficult to position the sealing ball in the horizontal portion. Further, pumping the sealing ball down the wellbore from the surface can slow the oil and gas production process.

What is needed, therefore, is a frac plug which can seal quickly without the need of secondary components.

SUMMARY

Embodiments of the disclosure may provide a frac plug. The frac plug may include a plug body, a slip, a sealing element, and a flapper. The plug body may have an inner surface, a first end portion, and a second end portion. The inner surface may define a bore extending axially between the first end portion and the second end portion. The slip may be circumferentially disposed about the plug body and configured to expand and couple the frac plug to a tubular section. The sealing element may be circumferentially disposed about the plug body and configured to compress and create a seal between the plug body and an inner surface of the tubular section. The flapper may be coupled to the plug body proximate the first end portion and configured to seal the bore of the plug body.

Embodiments of the disclosure may further provide another frac plug. The frac plug may include a plug body, a slip, a sealing element, and a flapper valve. The plug body may include a first sub and a second sub that is threadably engaged with the first sub. The slip may be circumferentially disposed about the plug body between the first sub and the second sub, and configured to expand and couple the frac plug to a tubular section. The slip may include a taper on an inner surface of the slip that extends along an axial length of the slip between a first end portion and a second end portion of the slip, and further include a thread pattern that is defined by an outer surface of the slip and that extends from the first end portion of the slip along a portion of the axial length. The sealing element may be circumferentially disposed about the first sub and configured to compress and create a seal between the plug body and an inner surface of the tubular section. The flapper valve may include a valve body coupled to the first sub and a flapper that includes an arm that is rotatably coupled to and configured to pivot about the valve body. The flapper may be configured to seal against the valve body and prevent fluid from traveling through the plug body.

Embodiments of the disclosure may further provide a method for isolating and re-opening a tubular section disposed in a wellbore. The method may include engaging a slip of a frac plug with an inner surface of the tubular section to retain the frac plug within the tubular section. The method may further include compressing a sealing element of the frac plug to create a seal between the frac plug and the inner surface of the tubular section. The method may also include closing a flapper of a flapper valve coupled to a first end portion of the frac plug to seal a bore of the frac plug and isolate the tubular section. The method may further include dissolving at least the flapper of the flapper valve to re-open the tubular section.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
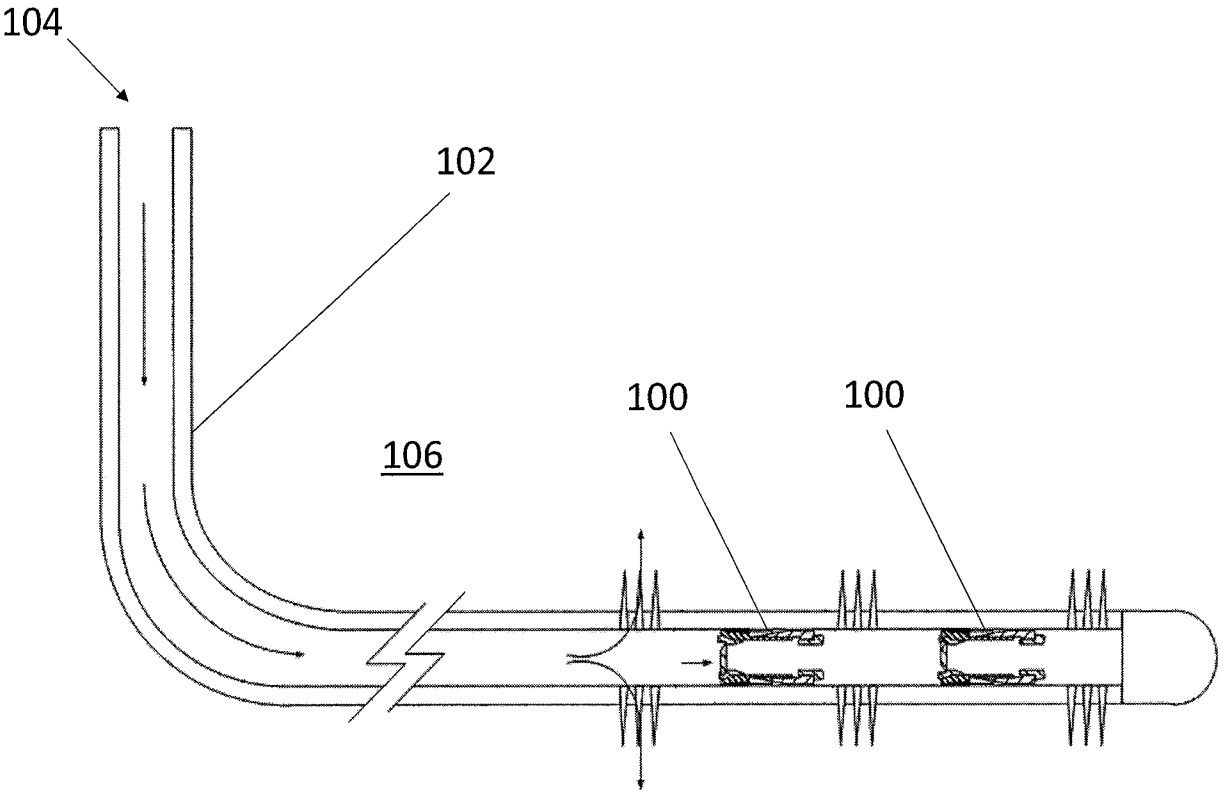
FIG. 1 illustrates a cutaway view of two closed exemplary frac plugs set in a tubular section of a wellbore formed in a subterranean formation, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Unless otherwise specified, use of the terms "up," "upper," "upward," "uphole," "upstream," or other like terms shall be construed as generally toward the surface of the formation or the surface of a body of water; likewise, use of "down," "lower," "downward," "downhole," "downstream," or other like terms shall be construed as generally away from the surface of the formation or the surface of a body of water, regardless of the wellbore orientation. Use of any one or more of the foregoing terms shall not be construed as denoting positions along a perfectly vertical axis.

Figure 2:
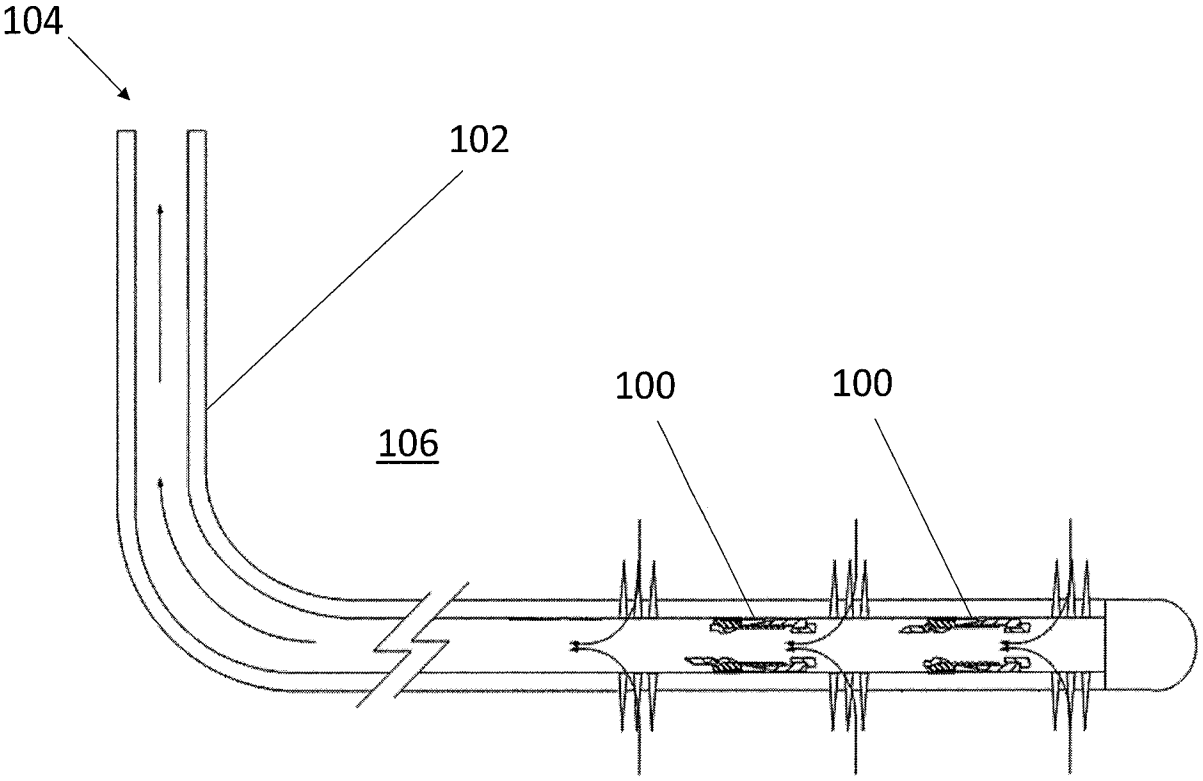
FIG. 2 illustrates the frac plugs of FIG. 1 in open positions.

FIGS. 1 and 2 illustrate cutaway views of exemplary frac plugs 100 set in a tubular 102 within a wellbore 104 formed in a subterranean formation 106, according to one or more embodiments disclosed. The wellbore 104 may be formed in the subterranean formation 106 via any conventional drilling means and is utilized for the retrieval of hydrocarbons therefrom. As illustrated, at least a portion of the wellbore 104 is oriented in a horizontal direction in the subterranean formation 106; however, embodiments in which the wellbore 104 is oriented in a convention vertical direction are contemplated herein, and the depiction of the wellbore 104 in a horizontal or vertical direction is not to be construed as limiting the wellbore 104 to any particular configuration. Accordingly, in some embodiments, the wellbore 104 may extend into the subterranean formation 106 in a vertical direction, thereby having a vertical wellbore portion, and may deviate at any angle from the vertical wellbore portion, thereby having a deviated or horizontal wellbore portion. Thus, the wellbore 104 may be or include portions that may be vertical, horizontal, deviated, and/or curved.

The wellbore 104 may be in fluid communication with the surface via a rig (not shown) and/or other associated components positioned on the surface around the wellbore 104. The rig may be a drilling rig or a workover rig, and may include a derrick and a rig floor. The frac plugs 100 may be delivered to a predetermined depth and positioned in the wellbore 104 via the rig to perform a part of a particular servicing operation such as, for example, isolating a section of the tubular 102 to allow fracturing of the subterranean formation 106.

Figure 3:
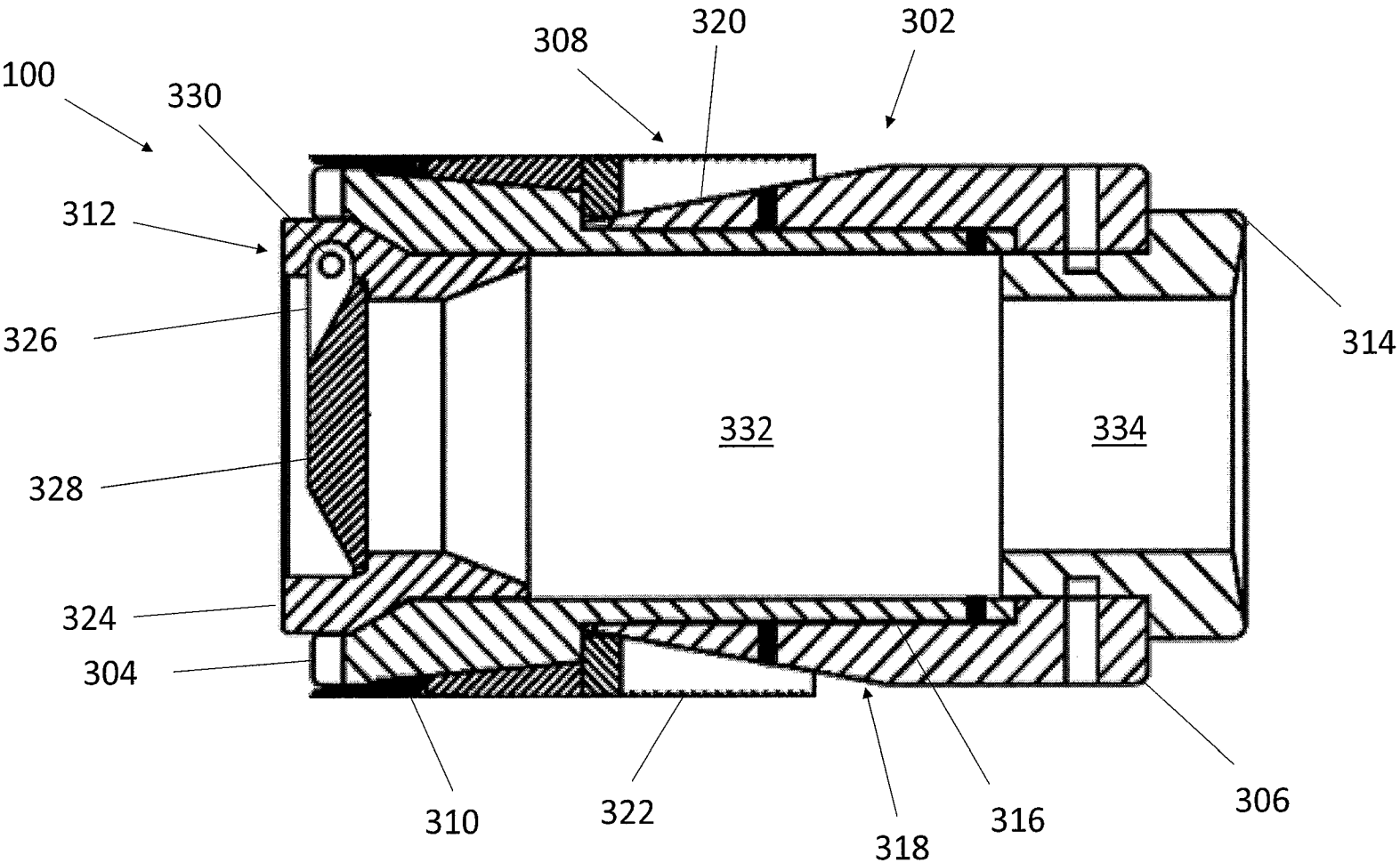
FIG. 3 illustrates a cross-sectional view of one of the frac plugs shown in FIG. 1.

Referring now to FIG. 3, FIG. 3 illustrates a cross-sectional view of one of the frac plugs 100 shown in FIG. 1. The frac plug 100 may include a plug body 302 that includes a first sub 304 and a second sub 306. Alternative embodiments of the frac plug 100 may instead include a plug body 302 having a single sub. The frac plug 100 may further include a slip 308, a sealing element 310, a flapper valve 312, and a setting ring 314.

The first sub 304, the second sub 306, or both may be cast, formed from a powdered metal, formed from a composite material, or include any combination thereof. In some embodiments, the frac plug 100 may include a first sub 304 and a second sub 306 that are different materials, such as a cast first sub 304 and a composite second sub 306. When assembled, the first sub 304 may be partially disposed within the second sub 306. As shown in FIG. 3, the first sub 304 may be coupled to the second sub 306 through a threaded connection 316. Further embodiments (not shown) of the frac plug 100 may include a single plug body 302 that includes a metal core bonded, threadably engaged, or otherwise coupled to an outer sleeve.

In the illustrated embodiment, the slip 308 is positioned between the first and second subs 304, 306 of the frac plug 100. A portion of the outer surface 318 of the second sub 306 is tapered. The slip 308 may include a tapered inner surface 320 that contacts the tapered outer surface 318 of the second sub 306. Further, the slip 308 may define a thread profile 322. In some embodiments, the thread profile 322 may be a left-hand thread profile. Additionally, each thread of the thread profile 322 may include a first flank that is longer than the second flank, angling a crest of each thread towards the second sub 306. Other embodiments may include threads having a first flank and a second flank that are similar in size, and the crests may be perpendicular to the slip 308. At least one embodiment of the slip 308 may include threads having crests angled in opposite directions. The sealing element 310 may be positioned about the first sub 304 and adjacent to the slip 308. As described in more detail below, compressing the frac plug 100 may cause the slip 308 to contact the sealing element 310 and position the sealing element 310 as shown in FIG. 3.

The flapper valve 312 may include a valve body 324, a rotatable arm 326, and a flapper 328. The valve body 324 may be coupled to the first sub 304 through an interference fit, interfacing threads, or other similar means. The rotatable arm 326 may couple the flapper 328 to the valve body 324. As shown in the exemplary embodiment, the rotatable arm 326 may be integrally formed with the flapper 328. Other embodiments may include a rotatable arm 326 that is coupled to the flapper 328 using fasteners, adhesives, welding, or other similar means.

A hinge 330 may allow the rotatable arm 326 to rotate about the valve body 324, opening and closing the flapper valve 312. In the closed position, shown in FIGS. 1 and 3, the flapper 328 contacts and seals against the valve body 324, preventing fluid from flowing through a bore 332 of the frac plug 100. In another embodiment, the flapper 328 may contact and seal against the first sub 304 to prevent fluid from flowing through the bore 332 of the frac plug 100. In the open position, shown in FIG. 2, the flapper 328 does not contact the valve body 324, allowing fluid to pass through the frac plug 100.

The flapper 328, rotatable arm 326, valve body 324, or any combination thereof may be made of dissolvable materials. The flapper 328 and rotatable arm 326, for example, may be made of a dissolvable rubber or plastic and valve body 324 may be made of a rigid dissolvable material. Other embodiments of the flapper valve 312 may be made of other dissolvable materials know in the industry. At least one embodiment of the frac plug 100 may include a rotatable arm 326 that is directly coupled to the first sub 304, omitting the valve body 324. In such an embodiment, the rotatable arm 326 and flapper 328 may be made of a dissolvable material.

Figure 4:
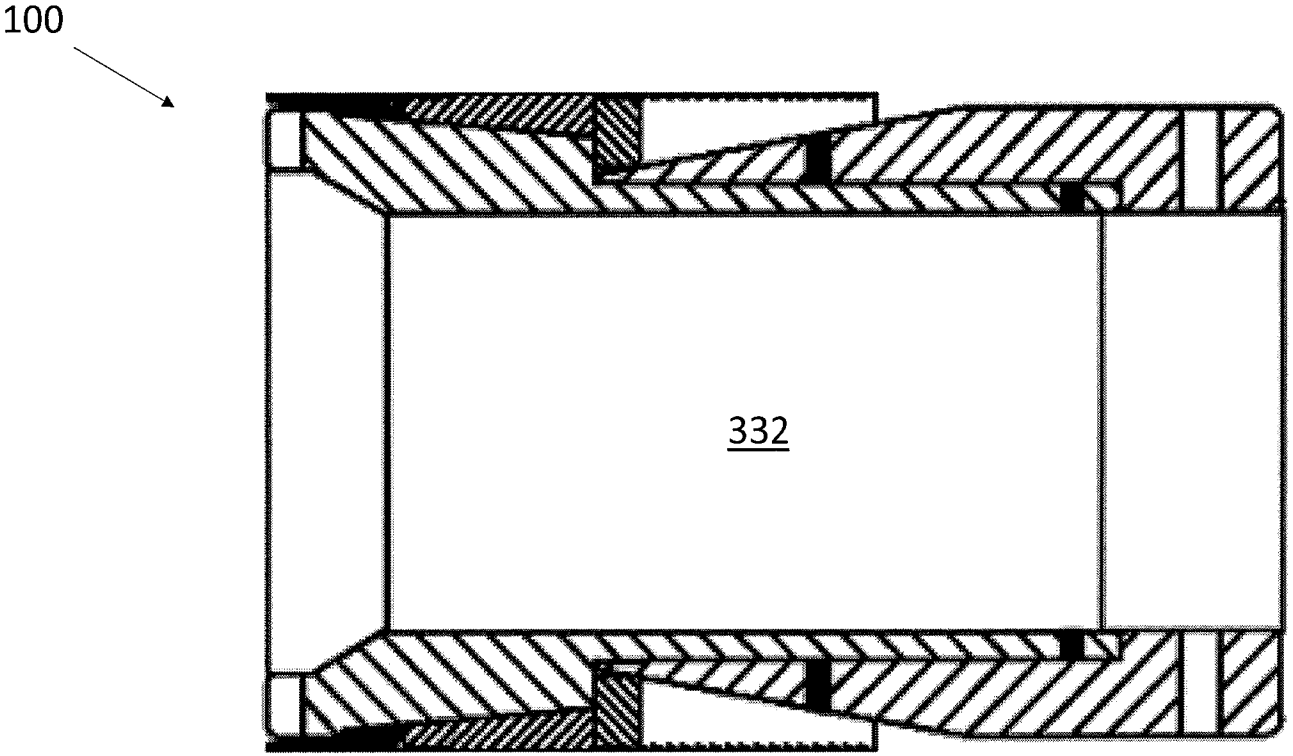
FIG. 4 illustrates a cross-sectional view of the frac plug of FIG. 3 after one or more components have dissolved.

The frac plug 100 may further include the setting ring 314. The setting ring 314 may be coupled to the second sub 306 through an interference fit, interfacing threads, or other similar means. As shown in the exemplary embodiment, the setting ring 314 may define a bore 334 that extends through the axial length of the setting ring 314. In one embodiment, the setting ring 314 may be made of a dissolvable material. Other embodiments of the setting ring 314 may be made of a powdered metal, cast iron, or composite material. After a period of time, the flapper valve 312 and the setting ring 314 may dissolve, allowing fluid to pass through the bore 332 without obstruction or a restriction caused by a reduction of the inner diameter of the bore 332, as shown in FIG. 4.

Figure 5:
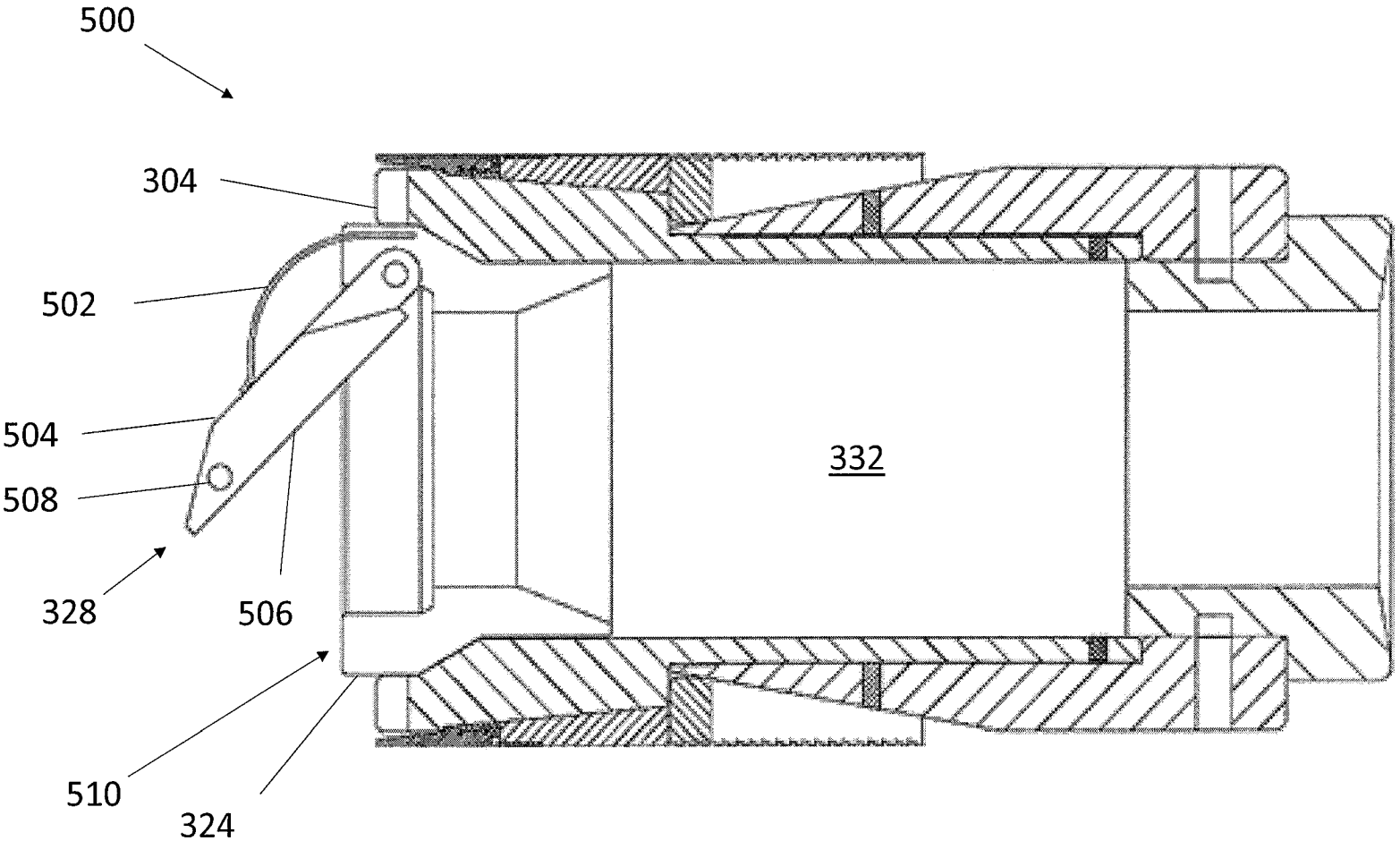
FIG. 5 illustrates a cross-sectional view of an exemplary frac plug, according to one or more embodiments disclosed.

FIG. 5 illustrates a cross-sectional view of an exemplary frac plug 500, according to one or more embodiments. Although the frac plug 500 in FIG. 5 is alternative to the frac plug 100 shown in FIGS. 1, 2, and 3, it is substantially similar in several respects. Accordingly, like numerals indicate like elements and therefore will not be described again in detail except where material to the present embodiment.

The frac plug 500 may further include a biasing member 502 coupled to the flapper 328 and the valve body 324. In embodiments which omit the valve body 324, the biasing member 502 may be coupled to the first sub 304. The biasing member 502 may hold the flapper 328 at an acute angle relative to a radial axis of the plug body 302 or the valve body 324 until a pressure is applied to either an upstream side 504 or a downstream side 506 of the flapper 328. In one embodiment, the biasing member 502 may be a spring. Other embodiments of the biasing member 502 may be made of a metal, rubber, or any other material that can flex to allow movement of the flapper 328 and return to an initial position when the pressure is no longer applied to the flapper 328. In addition to or in place of the biasing member 502, a shear pin 508 may extend from the flapper 328 and contact a first end portion 510 of the valve body 324. In another embodiment, the shear pin 508 may contact the first sub 304. The shear pin 508 may prevent the flapper 328 from sealing the bore 332 of the frac plug 500 until sufficient pressure is applied to the upstream side 504 of the flapper 328 to shear the shear pin 508 and close the flapper 328.

Figure 6:
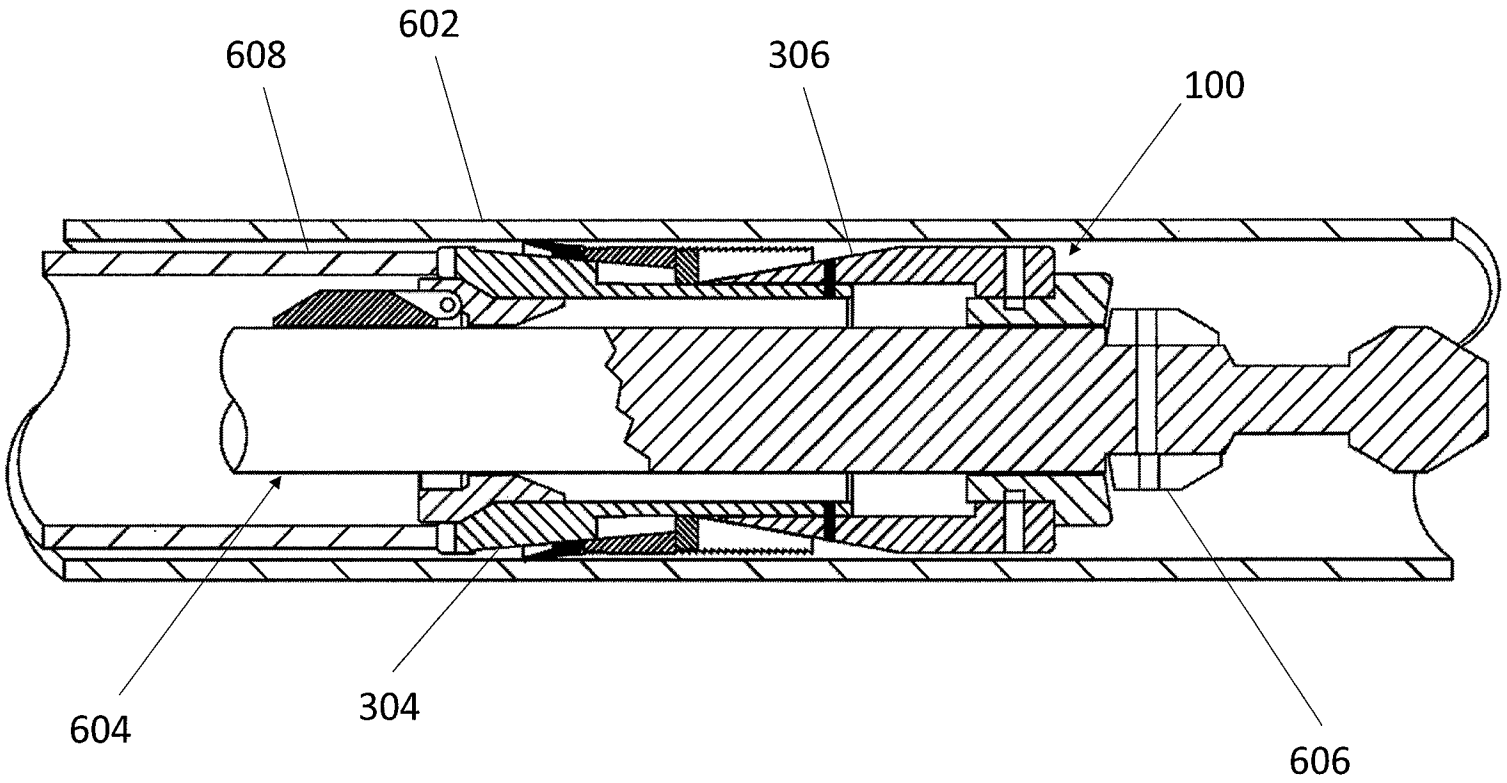
FIG. 6 illustrates the frac plug of FIG. 3 being run into the wellbore.

FIGS. 6-9 illustrate the installation of the frac plug 100 of FIGS. 1-3. Initially, the frac plug 100 is positioned within the tubular section 602 using a running tool 604 that extends through the frac plug 100, as shown in FIG. 6. The frac plug 100 is retained on the running tool 604 by a shear ring 606 configured to break at a predetermined load and a cylindrical retainer 608. The shear ring 606 may be positioned adjacent to the second sub 306 and the cylindrical retainer 608 may be positioned adjacent to the first sub 304. Once the frac plug 100 reaches the desired location, the running tool 604 begins to compress the frac plug 100 by pulling the shear ring 606 towards the cylindrical retainer 608. At least one embodiment of the running tool 604 may also push the cylindrical retainer 608 towards the shear ring 606.

Figure 7:
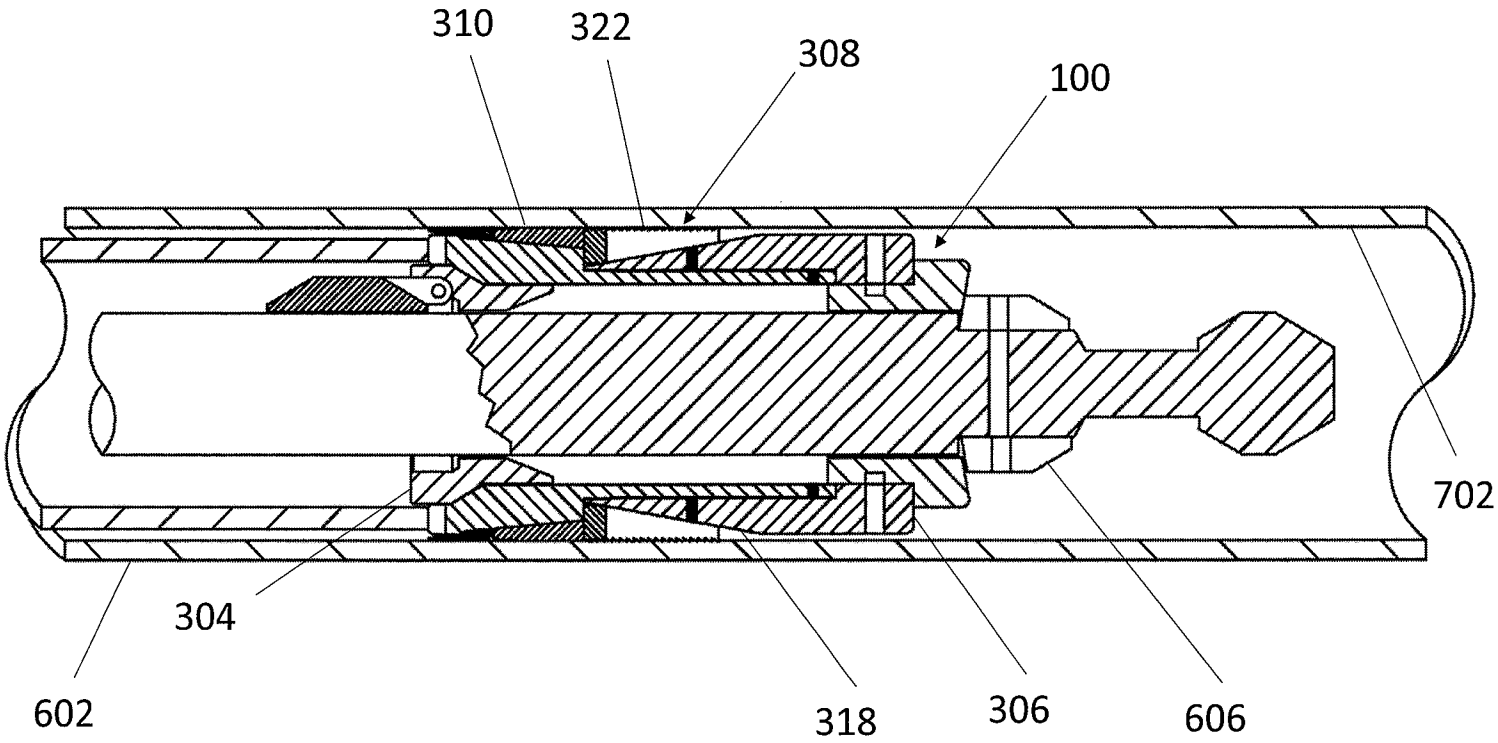
FIG. 7 illustrates the frac plug of FIG. 6 as the frac plug is being set in position within the tubular section.

As shown in FIG. 7, compressing the frac plug 100 may cause the tapered outer surface 318 of the second sub 306 to radially expand the slip 308. In some embodiments, this expansion may cause the slip 308 to fracture along longitudinal grooves (not shown), creating a plurality of slip segments (not shown). In another embodiment, the longitudinal grooves in the slip 308 may allow the slip 308 to expand without fracturing. Other embodiments may omit the longitudinal grooves.

As the frac plug 100 is compressed, the threads 322 defined by the slip 308 contact the tubular section 602. The threads 322 may engage or "bite" into the inner surface 702 of tubular section 602, retaining the frac plug 100 in position within the tubular section 602. The compression of the frac plug 100 may also cause the slip 308 to shift the sealing element 310 towards the first sub 304. This movement may position the sealing element 310 in the space between the frac plug 100 and the tubular section 602, creating a seal and preventing fluid from traveling around the exterior of the frac plug 100.

Figure 8:
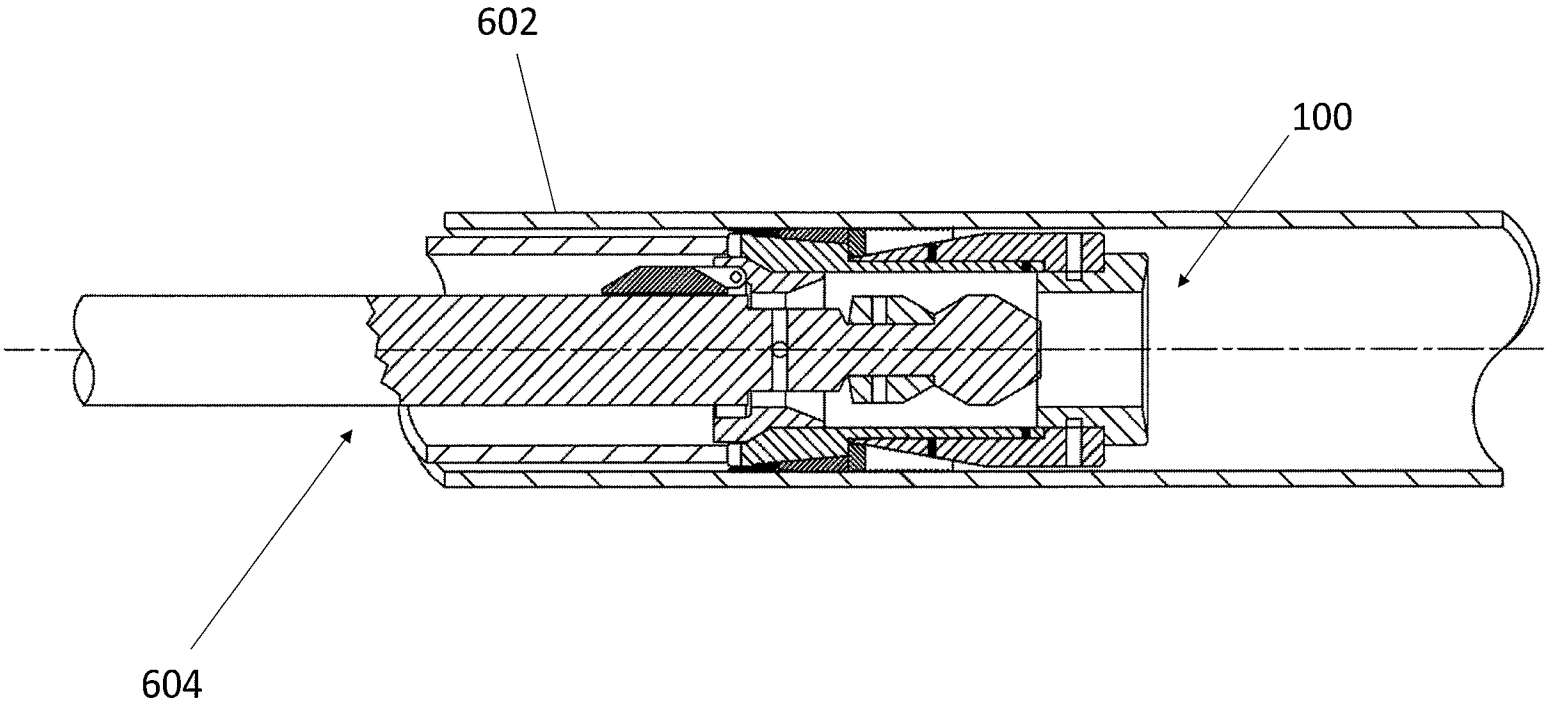
FIG. 8 illustrates the running tool being retracted from the frac plug of FIG. 7.
Figure 9:
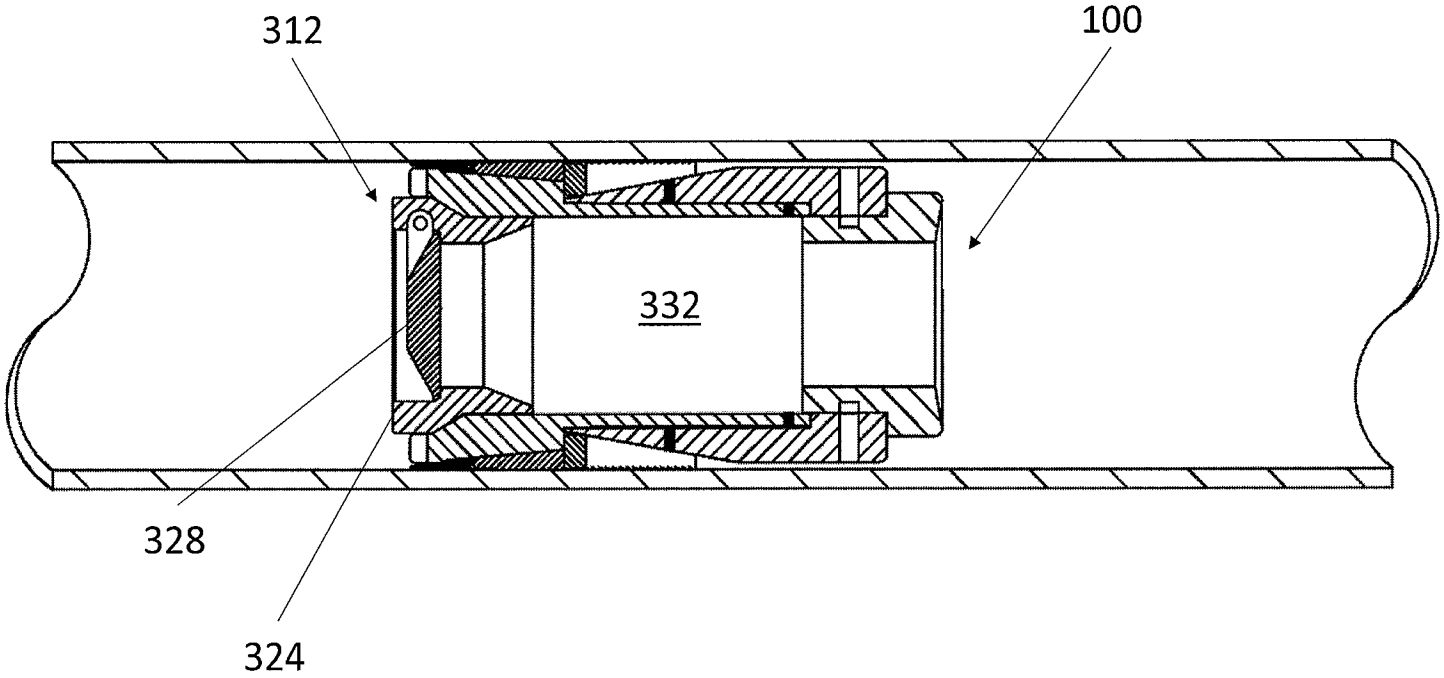
FIG. 9 illustrates the frac plug of FIG. 8 with the running tool fully retracted.

Once the frac plug 100 is set in position, the shear ring 606 will break when the predetermined load is reached. The running tool 604 is then tripped out of the tubular section 602, as shown in FIG. 8. After the running tool 604 is removed from the frac plug 100 and tubular section 602, as shown in FIG. 9, the flapper 328 seats against the valve body 324, closing the flapper valve 312 and sealing the bore 332 of the frac plug 100.

As shown in FIG. 1, fluid pressure applied to the flapper 328 during fracturing operations upstream of the frac plug 100 maintains the position of the flapper 328 against the valve seal 324, preventing fluid from traveling through the bore 332 of the frac plug 100. Once fracturing operations have been completed, pressure from hydrocarbons in the subterranean formation 106 causes the flapper valve 312 to open, as shown in FIG. 2, allowing production of the hydrocarbons. After a period of time, the flapper valve 312 and setting ring 314 may dissolve, allowing increased flow of the hydrocarbons through the frac plug 100.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A frac plug comprising:

a plug body having an inner surface, a first end portion, and a second end portion, the inner surface defining a bore extending axially between the first end portion and the second end portion;

a slip circumferentially disposed about the plug body and configured to expand and couple the frac plug to a tubular section;

a sealing element circumferentially disposed about the plug body and configured to compress and create a seal between the plug body and an inner surface of the tubular section;

a flapper coupled proximate the first end portion of the plug, the flapper configured to seal the bore of the plug body, wherein the sealing element is circumferentially disposed about an area of the plug body within which the flapper is coupled; and a shear pin that extends from the flapper and prevents the flapper from sealing the bore of the plug body until a pressure is applied to the flapper;

wherein the flapper has a first end portion and a second opposing end portion, wherein the first end portion of the flapper is coupled to the plug, and the second opposing end portion of the flapper is coupled to the shear pin.

2. The frac plug of claim 1, wherein the flapper comprises a dissolvable material.

3. The frac plug of claim 2, wherein the flapper comprises an arm rotatably coupled to and configured to pivot about a valve body coupled to the plug body.

4. The frac plug of claim 3, wherein the valve body comprises a dissolvable material.

5. The frac plug of claim 1, wherein the plug body comprises:

a first sub; and a second sub threadably engaged with the first sub in an area where an inner surface of the second sub overlaps an outer surface of the first sub.

6. The frac plug of claim 5, wherein the slip is disposed between the first sub and the second sub, the slip comprising:

a taper on an inner surface of the slip that extends along an axial length of the slip between a first end portion and a second end portion of the slip; and a thread pattern defined by an outer surface of the slip and extending from the first end portion of the slip along a portion of the axial length.

7. The frac plug of claim 1, further comprising a setting ring having an outer surface that engages the inner surface of the of the plug body.

8. The frac plug of claim 7, wherein the setting ring comprises a dissolvable material.

9. The frac plug of claim 1, further comprising a biasing member coupled to the flapper, the biasing member configured to retain the flapper at an acute angle relative to radial axis of the plug body until a pressure is applied to the flapper.

10. A frac plug comprising:

a plug body, comprising:

a first sub, and a second sub threadably engaged with the first sub;

a slip circumferentially disposed about the plug body between the first sub and the second sub, and configured to expand and couple the frac plug to a tubular section, the slip comprising:

a taper on an inner surface of the slip that extends along an axial length of the slip between a first end portion and a second end portion of the slip, and a thread pattern defined by an outer surface of the slip and extending from the first end portion of the slip along a portion of the axial length;

a sealing element circumferentially disposed about the first sub, the sealing element configured to compress and create a seal between the plug body and an inner surface of the tubular section; and a flapper valve comprising:

a valve body coupled to the first sub, and a flapper comprising an arm rotatably coupled to and configured to pivot about the valve body, the flapper configured to seal against the valve body and prevent fluid from traveling through the plug body.

11. The frac plug of claim 10, wherein the flapper comprises a dissolvable material.

12. The frac plug of claim 11, wherein the valve body comprises a dissolvable material.

13. The frac plug of claim 10, further comprising a setting ring having an outer surface that engages an inner surface of the second sub.

14. The frac plug of claim 13, wherein the setting ring comprises a dissolvable material.

15. The frac plug of claim 10, wherein the flapper valve further comprises a biasing member coupled to the flapper and the valve body, the biasing member configured to retain the flapper at an acute angle relative to a radial axis of the valve body until a pressure is applied to the flapper.

16. The frac plug of claim 10, wherein a shear pin extends from the flapper and prevents the flapper from sealing against the valve body until a pressure is applied to the flapper, wherein the arm of the flapper pivots at a first end portion of the flapper, and the shear pin extends from a second opposing end portion of the flapper.

17. A method for isolating and re-opening a tubular section disposed in a wellbore, comprising:

engaging a slip of a frac plug with an inner surface of the tubular section to retain the frac plug within the tubular section;

compressing a sealing element of the frac plug to create a seal between the frac plug and the inner surface of the tubular section, wherein the sealing element is compressed as a shear ring circumferentially disposed about a running tool breaks against an end of a setting ring of the frac plug while using the running tool to install the frac plug;

closing a flapper of a flapper valve coupled to a first end portion of the frac plug to seal the bore of the frac plug and isolate the tubular section; and dissolving at least the flapper of the flapper valve to re-open the tubular section.

18. The method of claim 17, wherein the closing of the flapper to the flapper valve further comprises flowing a fluid through the tubular section to apply a pressure to the flapper.

19. The method of claim 17, further comprising:

positioning the frac plug within the tubular section using the running tool; and compressing the frac plug with the running tool to expand the slip.

* * * * *